US010117486B2

(12) United States Patent
Cook

(10) Patent No.: US 10,117,486 B2
(45) Date of Patent: Nov. 6, 2018

(54) WIG STORAGE ASSEMBLY

(71) Applicant: Charlesetta Cook, St. Louis, MO (US)

(72) Inventor: Charlesetta Cook, St. Louis, MO (US)

( * ) Notice: Subject to any disclaimer, the term of this patent is extended or adjusted under 35 U.S.C. 154(b) by 0 days.

(21) Appl. No.: 15/437,279

(22) Filed: Feb. 20, 2017

(65) Prior Publication Data

US 2018/0235337 A1 Aug. 23, 2018

(51) Int. Cl.

| | |
|---|---|
| ***A45C 11/02*** | (2006.01) |
| ***A45D 44/14*** | (2006.01) |
| ***A47G 25/10*** | (2006.01) |
| ***A45C 13/03*** | (2006.01) |
| ***B65D 25/10*** | (2006.01) |
| ***B65D 25/14*** | (2006.01) |
| ***B65D 43/02*** | (2006.01) |

(52) U.S. Cl.

CPC ..... *A45C 11/02* (2013.01); *A45C 13/03* (2013.01); *A45D 44/14* (2013.01); *A47G 25/10* (2013.01); *B65D 25/10* (2013.01); *B65D 25/14* (2013.01); *B65D 43/02* (2013.01)

(58) Field of Classification Search

CPC ..... A45C 11/02; A45C 13/03; A45D 44/14; A47G 15/28

USPC ..... 206/8, 9; 223/86, 97, 33, 113

See application file for complete search history.

(56) References Cited

U.S. PATENT DOCUMENTS

| | | | | |
|---|---|---|---|---|
| 1,794,688 | A * | 3/1931 | Herrmann | A47G 25/22 211/119 |
| 3,289,822 | A * | 12/1966 | Schumer | B65D 11/02 206/8 |
| 3,327,842 | A * | 6/1967 | Meredith | A45C 11/00 206/8 |
| 3,587,836 | A * | 6/1971 | Brown | A45C 11/00 206/8 |
| 4,346,825 | A * | 8/1982 | Leger | A47G 25/28 211/113 |
| 4,590,910 | A * | 5/1986 | Lintott | F02M 59/34 123/458 |
| 4,678,079 | A * | 7/1987 | Henning | B65D 85/18 206/279 |
| 5,505,298 | A * | 4/1996 | Dlugopolski | B65D 5/067 206/279 |
| D587,565 | S | 3/2009 | Choi | |
| 8,439,510 | B2 * | 5/2013 | Uematsu | B60J 1/10 359/842 |
| 8,695,792 | B2 | 4/2014 | Choi | |
| 8,800,827 | B2 | 8/2014 | Choi | |
| 9,161,607 | B2 | 10/2015 | Choi | |
| 9,259,044 | B2 | 2/2016 | Kim et al. | |
| 2003/0159962 | A1 | 8/2003 | Heo | |
| 2008/0087618 | A1 * | 4/2008 | Laney | A47G 25/10 211/113 |
| 2008/0289974 | A1 * | 11/2008 | McClore | A45C 11/02 206/8 |
| 2015/0129455 | A1 * | 5/2015 | Williams | A45D 44/00 206/526 |

(Continued)

*Primary Examiner* — Sue A Weaver

(57) ABSTRACT

A wig storage assembly for storing wigs includes a stand that may have a wig positioned thereon. A first box is provided and the stand is selectively positioned therein to protect the wig. A lid is removably positioned on the first box to close the first box. A hanger is provided and configured a plurality of wigs is selectively suspended thereon. A second box is provided and the hanger is selectively positioned therein to protect the wig.

15 Claims, 4 Drawing Sheets

(56) References Cited

U.S. PATENT DOCUMENTS

| | | | | |
|---|---|---|---|---|
| 2015/0196143 | A1 | 7/2015 | Sterling | |
| 2015/0351574 | A1 | 12/2015 | Eslami et al. | |
| 2016/0076695 | A1* | 3/2016 | Henington ..... | A41G 3/00<br>132/53 |

* cited by examiner

WIG STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for storing wigs.

BRIEF SUMMARY OF THE INVENTION

An embodiment of the disclosure meets the needs presented above by generally comprising a stand that may have a wig positioned thereon. A first box is provided and the stand is selectively positioned therein to protect the wig. A lid is removably positioned on the first box to close the first box. A hanger is provided and configured a plurality of wigs is selectively suspended thereon. A second box is provided and the hanger is selectively positioned therein to protect the wig.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
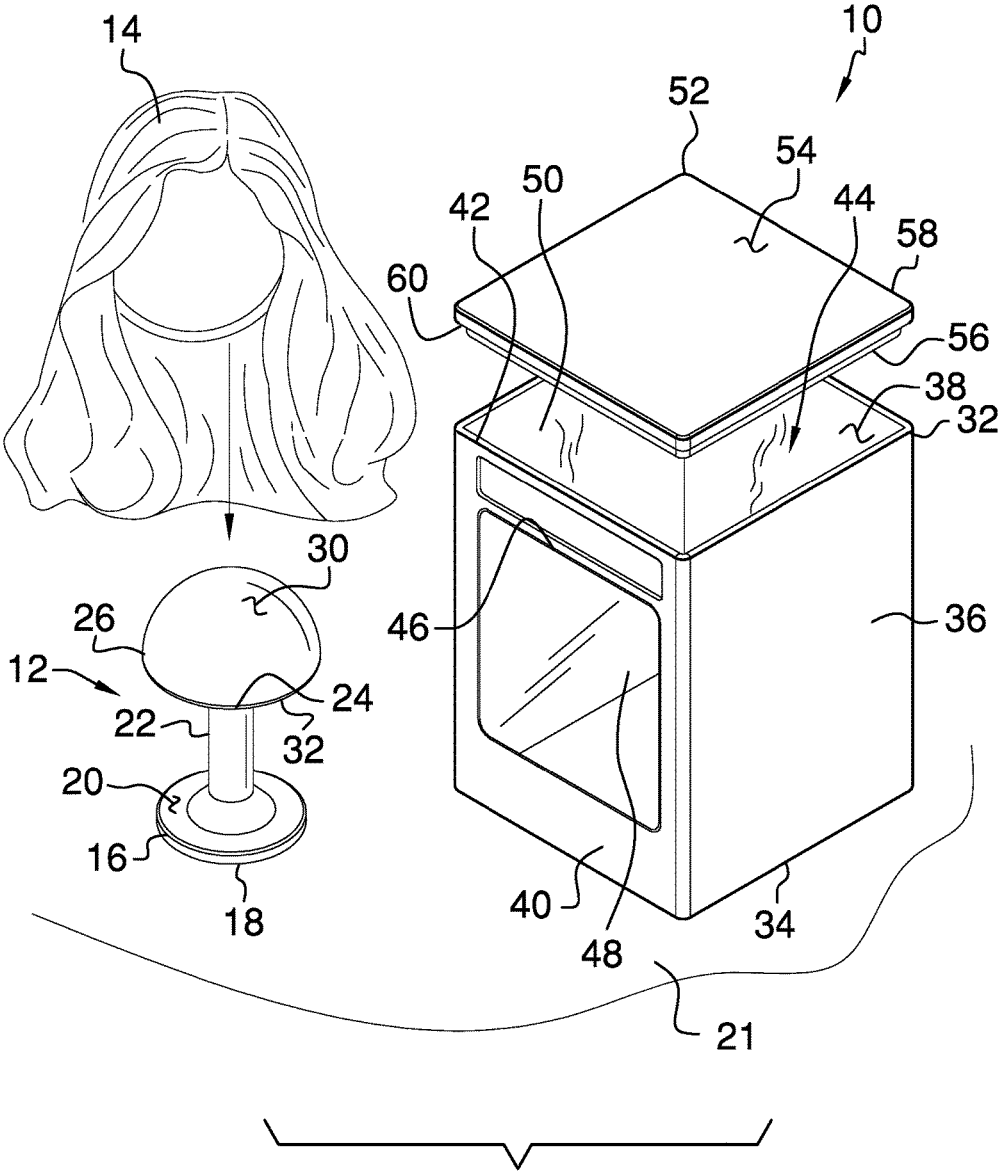
FIG. 1 is a perspective view of a first box and a stand of a wig storage assembly according to an embodiment of the disclosure.
Figure 2:
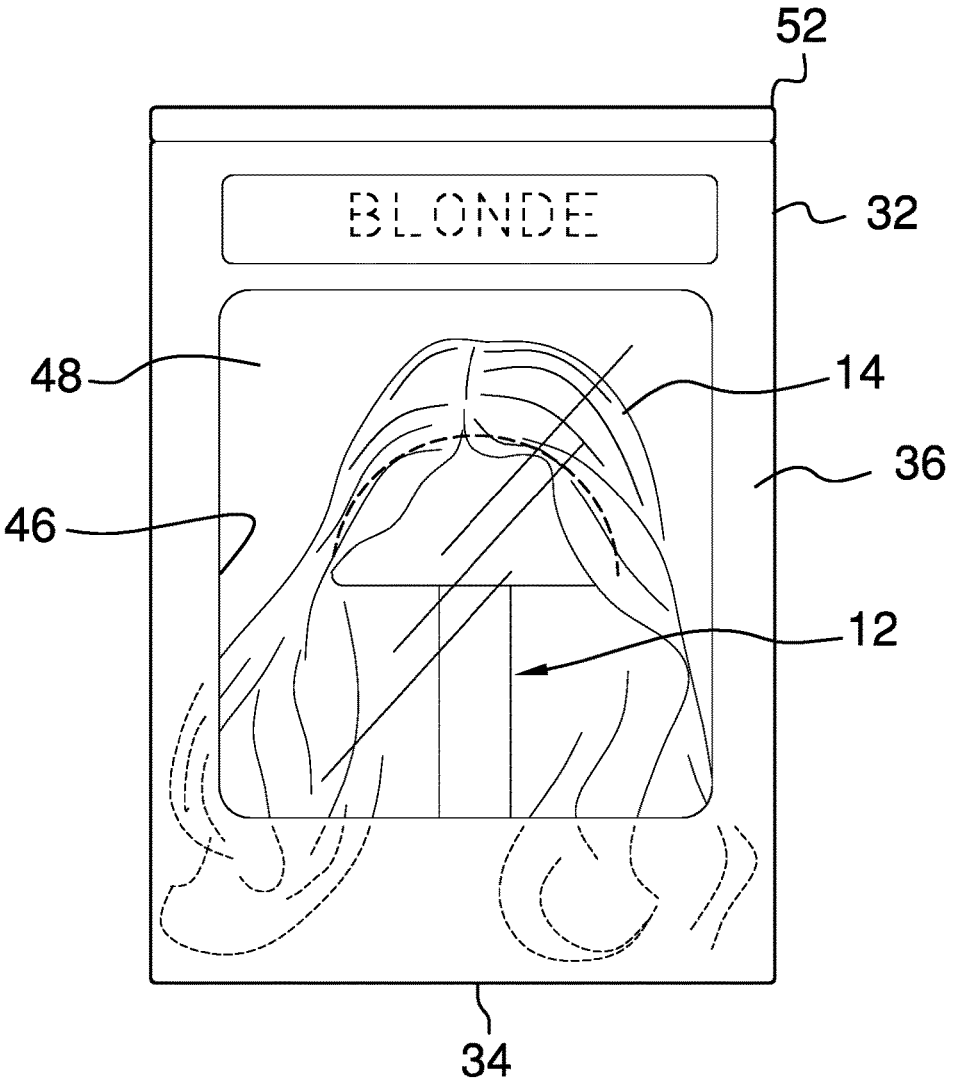
FIG. 2 is a perspective in-use view of first box and a stand of an embodiment of the disclosure.
Figure 3:
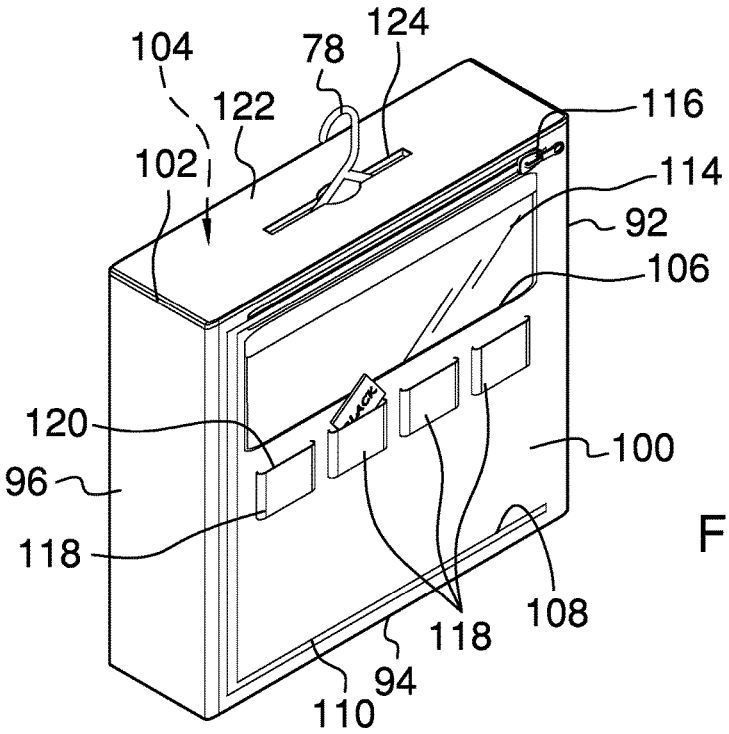
FIG. 3 is a perspective view of second box of an embodiment of the disclosure.
Figure 4:
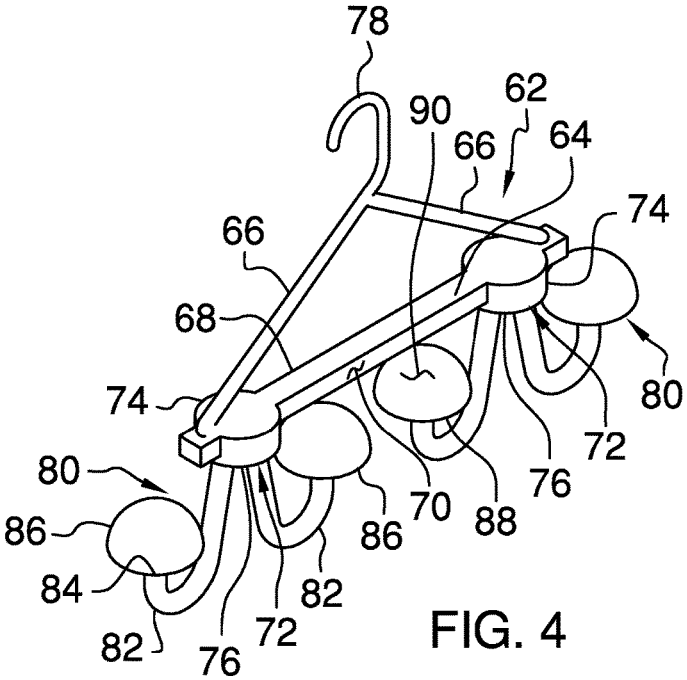
FIG. 4 is a perspective view of hanger of an embodiment of the disclosure.
Figure 5:
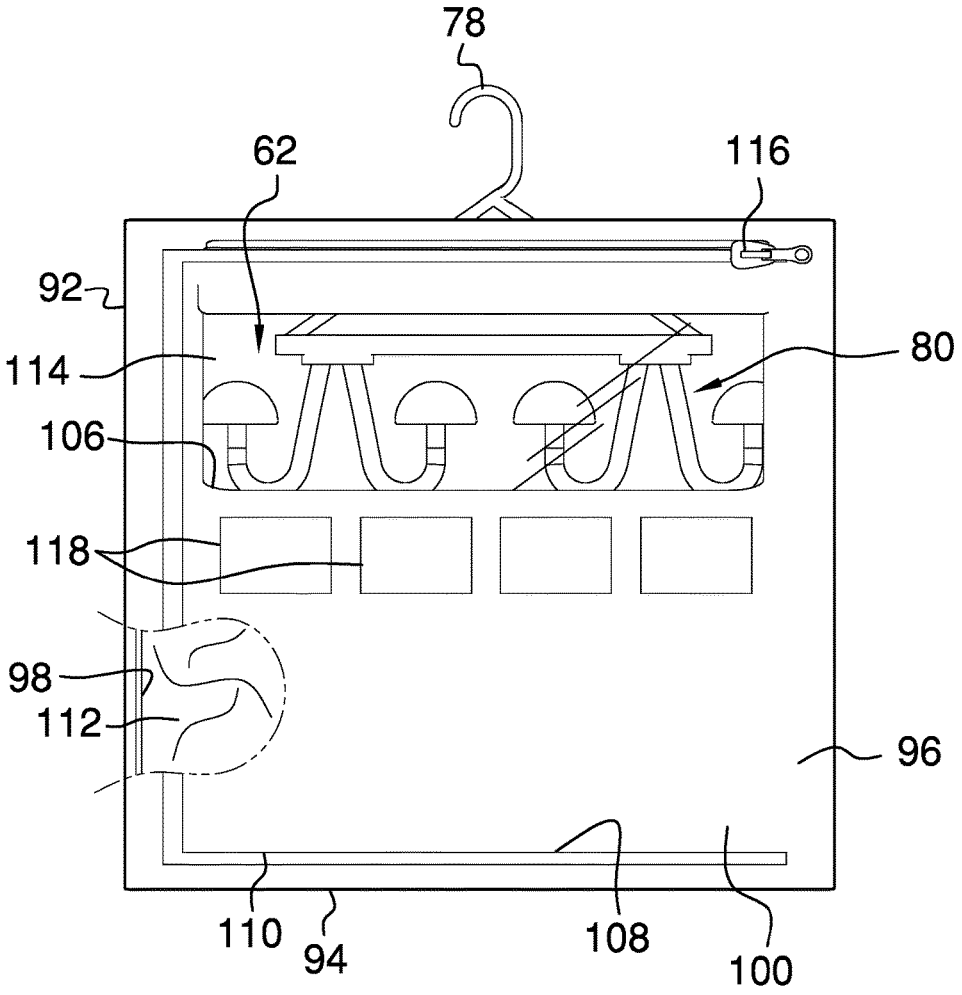
FIG. 5 is a perspective in-use view of second box and a hanger of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the wig storage assembly 10 generally comprises a stand 12 that may have a wig 14 positioned thereon. The wig 14 may be a wig of any conventional design to include, but not be limited to, synthetic wigs and human hair wigs. The stand 12 comprises a base 16 that has a first surface 18 and a second surface 20 and the first surface 18 abuts a support surface 21 when the stand 12 is positioned on the support surface 21. The support surface 21 may be a table top or the like. A stem 22 is coupled to and extends upwardly from the second surface 20 and the stem 22 has a distal end 24 with respect to the base 16.

A first dome 26 is provided that has a primary surface 28 and a secondary surface 30. The secondary surface 30 is concavely arcuate with respect to the primary surface 28 and the wig 14 is selectively positioned on the first dome 26. In this way the wig 14 is retained in a natural shape when the wig 14 is positioned on the stand 12 for storage. The primary surface 28 of the first dome 26 is coupled to the distal end 24 of the stem 22. The first dome 26 may be comprised of a resiliently compressible material thereby facilitating the wig 14 to be pinned to the first dome 26.

A first box 32 is provided and the stand 12 is selectively positioned in the first box 32 to protect the wig 14 during storage. The first box 32 has a bottom wall 34 and an outer wall 36 extending upwardly therefrom. The outer wall 36 has an inner surface 38, a front side 40 and a distal edge 42 with respect to the bottom wall 34. The distal edge 42 defines an opening 44 into the first box 32. The front side 40 has a hole 46 extending into an interior of the first box 32 to facilitate the wig 14 to be visible in the first box 32. A first window 48 is coupled to the front side 40 of the first box 32 and the first window 48 covers the hole 46. The first window 48 is comprised of a translucent material such as clear plastic or the like.

A first liner 50 is coupled to the inner surface 38 of the outer wall 36. The first liner 50 is comprised of a friction inhibiting material such as satin or the like. Moreover, the first liner 50 protects the wig 14 from abrasion and the first liner 50 is coextensive with the inner surface 38.

A lid 52 is removably positioned on the first box 32 to close the first box 32. The lid 52 has a first surface 54, a second surface 56 and a peripheral edge 58 extending therebetween. The second surface 20 has a groove 60 extending toward the first surface 54 and the groove 60 is coextensive with the peripheral edge 58. The distal edge 42 of the first box 32 is positioned in the groove 60 when the lid 52 is positioned on the first box 32.

A hanger 62 is provided and the hanger 62 and a plurality of the wigs 14 are selectively suspended on the hanger 62 for storage. The hanger 62 comprises a central member 64 that is coupled to and extends between a pair of outward members 66. The outward members 66 intersect each other such that the hanger 62 has a triangular shape. The central member 64 has a rear surface 68 and a front surface 70 and each of the rear surface 68 and the front surface 70 has a pair of curved portions 72. Each of the curved portions 72 corresponding to the rear surface 68 and the front surface 70 is concavely arcuate with respect to a longitudinal axis of the central member 64 to define a pair of disks 74. Each of the disks 74 has a bottom surface 76 and the disks 74 are spaced apart from each other.

A hook 78 is coupled to and extends upwardly from the hanger 62 at an intersection between the outward members 66. The hook 78 selectively engages an object thereby facilitating the hanger 62 to be suspended from the object. The object may be a closet pole or the like.

A pair of supports 80 is provided and each of the supports 80 is coupled to and extends downwardly from an associated one of the disks 74. Each of the plurality of wigs 14 is selectively positioned on each of the supports 80 for storage. Each of the supports 80 comprises a pair of arms 82 that are each coupled to and extending downwardly from the bottom surface 76 corresponding to an associated one of the disks 74. Each of the arms 82 has a distal end 84 with respect to the associated disk 74. Moreover, each of the arms 82 is curved between the associated disk 74 and the distal end 24 such that each of the arms 82 has a J shape.

A pair of second domes 86 is provided and each of the second domes 86 has a lower surface 88 and an upper surface 90. The upper surface 90 corresponding to each of the second domes 86 is concavely arcuate with respect to the lower surface 88 of the corresponding second dome. A selected wig 14 is selectively positioned on a selected one of the second domes 86 for storage. Each of the second domes 86 retains the wig 14 in a natural shape when the wig 14 is stored. Each of the second domes 86 may be comprised of a resiliently compressible material thereby facilitating the wig 14 to be pinned to each of the second domes 86.

A second box 92 is provided and the hanger 62 is selectively positioned in the second box 92 to protect the wig 14 during storage. The second box 92 has a basal wall 94 and an exterior wall 96 extending upwardly therefrom. The exterior wall 96 has an inside surface 98, a forward side 100 and a distal edge 102 with respect to the basal wall 94. The distal edge 102 of the exterior wall 96 defines an opening 104 into the second box 92.

The forward side 100 has an aperture 106 extending into an interior of the second box 92 to facilitate the wig 14 to be visible in the second box 92. The front side 40 has a cut 108 extending into an interior of the second box 92 and the cut 108 is substantially coextensive with a perimeter of the front side 40. The cut 108 defines a flap 110 wherein the flap 110 to facilitate the wig 14 in the second box 92 to be accessible.

A second liner 112 is coupled to the inside surface 98 of the exterior wall 96 and the second liner 112 is coextensive with the exterior wall 96. The second liner 112 is comprised of a friction inhibiting material such as satin or the like. In this way the second liner 112 protects the wig 14 in the second box 92 from abrasion. A second window 114 is coupled to the forward side 100 of the second box 92 and the second window 114 covers the aperture 106. The second window 114 may be comprised of a translucent material such as clear plastic or the like.

A fastener 116 is movably coupled to the second box 92 and the fastener 116 is selectively manipulated. The fastener 116 is coextensive with the cut 108 such that the fastener 116 selectively opens and closes the flap 110. The fastener 116 may comprise a zipper or the like. A plurality of pockets 118 is provided and each of the pockets 118 is coupled to the forward side 100 of the second box 92. Each of the pockets 118 has a top side 120 and the top side 120 corresponding to each of the pockets 118 is open. Moreover, each of the pockets 118 may be comprised of a translucent material such as clear plastic or the like.

A plurality of cards may each be positioned in an associated one of the pockets 118. Each of the pockets 118 is aligned with an associated one of the second domes 86 when the hanger 62 is positioned in the second box 92. Each of the cards may be written on and to label a color associated with the wig 14 corresponding to each of the second domes 86.

A cover 122 is hingedly coupled to the second box 92 and the cover 122 selectively closes the second box 92. The cover 122 is positioned on the distal edge 102 corresponding to the second box 92 and the cover 122 has a slot 124 extending therethrough. The hook 78 on the hanger 62 extends outwardly through the slot 124 when the hanger 62 is positioned in the second box 92.

In use, the wig 14 is positioned on the first dome 26 for storage. The stand 12 is selectively placed in the first box 32 such that the wig 14 is stored in the first box 32. The lid 52 is positioned on the first box 32 to close the first box 32 and the first box 32 is stored. A plurality of the wigs 14 is each selectively positioned on an associated one of the second domes 86 on the hanger 62. The hanger 62 is positioned in the second box 92 and the cover 122 is closed. The hook 78 extends through the slot 124 in the cover 122 and the hook 78 is suspended from the object. In this way the second box 92 and each of the plurality of wigs 14 is stored. The first box 32 and the second box 92 protect the wigs 14 thereby enhancing a service life of the wigs 14. Moreover, the second box 92 is carried during travel.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wig storage assembly being configured to store a wig thereby preserving styling of the wig, said assembly comprising:

a stand being configured to have a wig positioned thereon, said stand comprising:

a base having a first surface and a second surface, said first surface being configured to abut a support surface, a stem being coupled to and extending upwardly from said second surface, said stem having a distal end with respect to said base, and a first dome having a primary surface and a secondary surface, said secondary surface being concavely arcuate with respect to said primary surface wherein said secondary surface is configured to have a wig positioned thereon, said primary surface being coupled to said distal end of said stem;

a first box having said stand being selectively positioned therein wherein said first box is configured to protect the wig, said first box having a bottom wall and an outer wall extending upwardly therefrom, said outer wall having an inner surface, a front side and a distal edge with respect to said bottom wall, said distal edge defining an opening into said first box, said front side having a hole extending into an interior of said first box wherein said hole is configured to facilitate the wig to be visible in said first box;

a first window being coupled to said front side of said first box, said first window covering said hole;

a first liner being coupled to said inner surface of said outer wall, said first liner being comprised of a friction inhibiting material wherein said first liner is configured to protect the wig from abrasion, said first liner being coextensive with said inner surface;

a lid being removably positioned on said first box to close said first box, said lid having a first surface, a second surface and a peripheral edge extending therebetween, said second surface having a groove extending toward said first surface, said groove being coextensive with said peripheral edge, said distal edge of said first box being positioned in said groove when said lid is positioned on said first box;

a hanger being configured to have a plurality of wigs suspended thereon, said hanger comprising:

a central member being coupled to and extending between a pair of outward members, said outward members intersecting each other such that said hanger has a triangular shape, said central member having a rear surface and a front surface, each of said rear surface and said front surface having a pair of curved portions, each of said curved portions corresponding to said rear surface and said front surface being concavely arcuate with respect to a longitudinal axis of said central member to define a pair of disks, each of said disks having a bottom surface, said disks being spaced apart from each other, a hook being coupled to and extending upwardly from said hanger at an intersection between said outward members wherein said hook is configured to engage an object thereby facilitating said hanger to be suspended from the object, and a pair of supports, each of said supports being coupled to and extending downwardly from an associated one of said disks wherein each of said supports is configured to have a plurality of wigs positioned thereon, each of said supports comprising:

a pair of arms, each of said arms being coupled to and extending downwardly from said bottom surface corresponding to an associated one of said disks, each of said arms having a distal end with respect to said associated disk, each of said arms being curved between said associated disk and said distal end such that each of said arms has a J shape, and a pair of second domes, each of said second domes having a lower surface and an upper surface, said upper surface corresponding to each of said second domes being concavely arcuate with respect to said lower surface of said corresponding second dome wherein each of said second domes is configured to have a wig positioned thereon; and a second box having said hanger being selectively positioned therein wherein said second box is configured to protect the wig, said second box having a basal wall and an exterior wall extending upwardly therefrom, said exterior wall having an inside surface, a forward side and a distal edge with respect to said basal wall, said distal edge of said exterior wall defining an opening into said second box, said forward side having an aperture extending into an interior of said second box wherein said aperture is configured to facilitate the wig to be visible in said second box, said front side having a cut extending into an interior of said second box, said cut being substantially coextensive with a perimeter of said front side to define a flap wherein said flap is configured to facilitate the wig in said second box to be accessible;

a second liner being coupled to said inside surface of said exterior wall, said second liner being coextensive with said exterior wall, said second liner being comprised of a friction inhibiting material wherein said second liner is configured to protect the wig in said second box from abrasion;

a second window being coupled to said forward side of said second box, said second window covering said aperture;

a plurality of pockets, each of said pockets being coupled to said forward side of said second box, each of said pockets having a top side, said top side corresponding to each of said pockets being open; and a cover being hingedly coupled to said second box wherein said cover is configured to selectively close said second box, said cover being positioned on said distal edge corresponding to said second box, said cover having a slot extending therethrough, said hook on said hanger extending outwardly through said slot when said hanger is positioned in said second box.

2. A wig storage assembly being configured to store a wig thereby preserving styling of the wig, said assembly comprising:

a stand being configured to have a wig positioned thereon;

a first box having said stand being selectively positioned therein wherein said first box is configured to protect the wig;

a lid being removably positioned on said first box to close said first box;

a hanger being configured to have a plurality of wigs suspended thereon;

a second box having said hanger being selectively positioned therein wherein said second box is configured to protect the wig;

said second box having a basal wall and an exterior wall extending upwardly therefrom, said exterior wall having an inside surface, a forward side and a distal edge with respect to said basal wall, said distal edge of said exterior wall defining an opening into said second box, said forward side having an aperture extending into an interior of said second box wherein said aperture is configured to facilitate the wig to be visible in said second box; and said front side having a cut extending into an interior of said second box, said cut being substantially coextensive with a perimeter of said front side to define a flap wherein said flap is configured to facilitate the wig in said second box to be accessible.

3. The assembly according to claim 2, further comprising a plurality of pockets, each of said pockets being coupled to said forward side of said second box, each of said pockets having a top side, said top side corresponding to each of said pockets being open.

4. The assembly according to claim 2, further comprising:

a hook being coupled to said hanger; and a cover being hingedly coupled to said second box wherein said cover is configured to selectively close said second box, said cover being positioned on said distal edge corresponding to said second box, said cover having a slot extending therethrough, said hook on said hanger extending outwardly through said slot when said hanger is positioned in said second box.

5. The assembly according to claim 2, further comprising said stand comprises a base having a first surface and a second surface, said first surface being configured to abut a support surface.

6. The assembly according to claim 5, further comprising a stem being coupled to and extending upwardly from said second surface, said stem having a distal end with respect to said base.

7. The assembly according to claim 6, further comprising a first dome having a primary surface and a secondary surface, said secondary surface being concavely arcuate with respect to said primary surface wherein said secondary surface is configured to have a wig positioned thereon, said primary surface being coupled to said distal end of said stem.

8. The assembly according to claim 2, wherein said first box has a bottom wall and an outer wall extending upwardly therefrom, said outer wall having an inner surface, a front side and a distal edge with respect to said bottom wall, said distal edge defining an opening into said first box, said front side having a hole extending into an interior of said first box wherein said hole is configured to facilitate the wig to be visible in said first box.

9. The assembly according to claim 2, wherein said hanger comprises a central member being coupled to and extending between a pair of outward members, said outward members intersecting each other such that said hanger has a triangular shape, said central member having a rear surface and a front surface.

10. The assembly according to claim 9, further comprising a hook being coupled to and extending upwardly from said hanger at an intersection between said outward members wherein said hook is configured to engage an object thereby facilitating said hanger to be suspended from the object.

11. A wig storage assembly being configured to store a wig thereby preserving styling of the wig, said assembly comprising:

a stand being configured to have a wig positioned thereon;

a first box having said stand being selectively positioned therein wherein said first box is configured to protect the wig, said first box having a bottom wall and an outer wall extending upwardly therefrom, said outer wall having an inner surface, a front side and a distal edge with respect to said bottom wall, said distal edge defining an opening into said first box, said front side having a hole extending into an interior of said first box wherein said hole is configured to facilitate the wig to be visible in said first box;

a lid being removably positioned on said first box to close said first box;

a hanger being configured to have a plurality of wigs suspended thereon;

a second box having said hanger being selectively positioned therein wherein said second box is configured to protect the wig; and a first liner being coupled to said inner surface of said outer wall, said first liner being comprised of a friction inhibiting material wherein said first liner is configured to protect the wig from abrasion, said first liner being coextensive with said inner surface.

12. A wig storage assembly being configured to store a wig thereby preserving styling of the wig, said assembly comprising:

a stand being configured to have a wig positioned thereon;

a first box having said stand being selectively positioned therein wherein said first box is configured to protect the wig, said first box having a bottom wall and an outer wall extending upwardly therefrom, said outer wall having an inner surface, a front side and a distal edge with respect to said bottom wall, said distal edge defining an opening into said first box, said front side having a hole extending into an interior of said first box wherein said hole is configured to facilitate the wig to be visible in said first box;

a lid being removably positioned on said first box to close said first box;

a hanger being configured to have a plurality of wigs suspended thereon;

a second box having said hanger being selectively positioned therein wherein said second box is configured to protect the wig; and said lid having a first surface, a second surface and a peripheral edge extending therebetween, said second surface having a groove extending toward said first surface, said groove being coextensive with said peripheral edge, said distal edge of said first box being positioned in said groove when said lid is positioned on said first box.

13. A wig storage assembly being configured to store a wig thereby preserving styling of the wig, said assembly comprising:

a stand being configured to have a wig positioned thereon;

a first box having said stand being selectively positioned therein wherein said first box is configured to protect the wig;

a lid being removably positioned on said first box to close said first box;

a hanger being configured to have a plurality of wigs suspended thereon, said hanger comprising a central member being coupled to and extending between a pair of outward members, said outward members intersecting each other such that said hanger has a triangular shape, said central member having a rear surface and a front surface;

a second box having said hanger being selectively positioned therein wherein said second box is configured to protect the wig; and each of said rear surface and said front surface has a pair of curved portions, each of said curved portions corresponding to said rear surface and said front surface being concavely arcuate with respect to a longitudinal axis of said central member to define a pair of disks, each of said disks having a bottom surface, said disks being spaced apart from each other.

14. The assembly according to claim 13, further comprising a pair of supports, each of said supports being coupled to and extending downwardly from an associated one of said disks wherein each of said supports is configured to have a plurality of wigs positioned thereon.

15. The assembly according to claim 14, further comprising each of said supports comprises a pair of arms, each of said arms being coupled to and extending downwardly from said bottom surface corresponding to an associated one of said disks, each of said arms having a distal end with respect to said associated disk, each of said arms being curved between said associated disk and said distal end such that each of said arms has a J shape.

* * * * *